United States Patent [19]

Clatworthy et al.

[11] Patent Number: 4,750,950

[45] Date of Patent: Jun. 14, 1988

[54] HEAT TREATED ALLOY

[75] Inventors: Edward F. Clatworthy; Pasupathy Ganesan; Jerry A. Harris, all of Huntington, W. Va.

[73] Assignee: Inco Alloys International, Inc., Huntington, W. Va.

[21] Appl. No.: 932,284

[22] Filed: Nov. 19, 1986

[51] Int. Cl.[4] ..... C22F 1/16; C22C 30/00

[52] U.S. Cl. ..... 148/158; 148/162; 148/419

[58] Field of Search ..... 148/3, 158, 162, 419, 148/442

[56] References Cited

U.S. PATENT DOCUMENTS 4,358,511 11/1982 Smith, Jr. et al. ..... 420/448

FOREIGN PATENT DOCUMENTS 132055 1/1985 European Pat. Off. ..... 148/419

*Primary Examiner*—John P. Sheehan
*Assistant Examiner*—George Wyszomierski
*Attorney, Agent, or Firm*—Raymond J. Kenny; Francis J. Mulligan, Jr.

[57] ABSTRACT

A process for heat treating alloy objects which comprises solution treating a nickel-base alloy containing chromium, molybdenum, copper, titanium, aluminum and iron at a temperature in excess of 955° C. and then aging the alloy without intervening cold work at a temperature in the range of 700° C. to 720° C. This treatment provides non-cold worked structure which is tough, not susceptible to stress corrosion cracking in a test environment simulating a sour gas well environment and which exhibits high level of fracture energy in a slow strain rate tensile test in that environment.

10 Claims, No Drawings

HEAT TREATED ALLOY

The present invention is concerned with an alloy structure essentially devoid of sigma phase which is not subjected to cold work and which, at room temperature, exhibits a 0.2% offset yield strength of at least about 517 MPa and, advantageously, at least about 689 MPa.

BACKGROUND OF THE ART PROBLEM

An alloy within the confines of U.S. Pat. No. 4,358,511 and sold commercially is generally heat treated after solutioning and cold working by aging the alloy at about 732–733° C. for 1 to about 24 hours, furnace cooling the cold worked and aged alloy to about 621–622° C., holding at that temperature for about 8 hours and then cooling in air. In so far as we are aware this procedure results in alloy objects, structures and the like which are adapted to be employed under high stress in sour gas oil well environments without danger of stress corrosion cracking. The solution treated cold worked and aged alloy generally exhibits a 0.2% offset Yield Strength at room temperature of at least 689 MPa.

A different situation prevails if the alloy is not cold worked after solution treatment. Slow strain rate tensile tests conducted at a temperature of 204° C. in an aqueous chloride medium slightly acidified with acetic acid and containing hydrogen sulfide have shown that non-cold worked specimens of the commercial alloy aged at 732° C. to greater than 590 MPa e.g., greater than 689 MPa 0.2% offset yield strength at room temperature are sensitive to stress corrosion cracking. This laboratory observation duplicates practical experience of stress corrosion cracking of valve bodies made of the non-cold worked commercial alloy heat treated as described above.

The problem is to provide large section alloy bodies, e.g., valve bodies, tube hangers, drill collars, various other items of oil well tooling, etc., which are not cold worked after solution treatment, which are aged to a 0.2% offset Yield Strength at room temperature of at least 517 MPa and which are resistant to stress corrosion cracking. Needless to say, other mechanical characteristics of engineering significance of the commercial alloy such as Ultimate Tensile Strength, ductility, impact resistance, etc. should not be detrimentally affected by whatever means are employed to provide a solution to the problem. Specifically, the alloy body should be free of detrimental phases such as sigma phase.

BRIEF DESCRIPTION OF THE INVENTION

The present invention contemplates an alloy structure in the condition resulting from solution annealing and aging, without cold working intervening, said structure being made from an alloy containing, comprising or consisting essentially of (in percent by weight) about 38–46% nickel, about 19–24% chromium, about 2–4% molybdenum, about 1–3.5% copper, about 1 to 2.3% titanium, about 0.1–0.6% aluminum, the sum of the aluminum plus titanium being about 1.5–2.8%, up to about 3.5% niobium, up to 0.15% carbon, up to 0.1% nitrogen, the balance being essentially all iron. The alloy can also contain up to about 5% cobalt, up to 0.5% silicon and up to 1% manganese. Detrimental elements such as sulfur, phosphorus, arsenic, lead, antimony and the like should be maintained at the minimum practical level. Once the alloy structure is cast and, if required, worked hot or cold to the configuration necessitated by the alloy object, the structure is solution treated in the range of greater than 955° and up to 1100° C. (e.g., 960° to 1100° C.) and then aged for at least about 8 hours, e.g., about 8 to 30 hours of temperature above about 700° C. and below 732° C. e.g., about 700° C. to about 720° C. for a time sufficient to induce in the structure a room temperature 0.2% offset Yield Strength of at least 517 MPa and, advantageously, at least about 689 MPa. Advantageously the aging at 700–720° C. is followed by furnace cooling to about 620–625° C. and holding at that temperature for about 4 to 12 hours followed by air cooling.

GENERAL DESCRIPTION OF THE INVENTION

Alloy objects of the present invention advantageously have compositions within the range and substantially the specific alloy composition in weight percent set forth in Table I.

TABLE I

| Element | Advantageous Range | Specific Alloy |
|---|---|---|
| Ni | 42–46 | 42.18* |
| Cr | 19.5–22.5 | 21.98 |
| Mo | 2.5–3.5 | 2.70 |
| Cu | 1.5–3.0 | 1.81 |
| Ti | 1.9–2.3 | 1.97 |
| Al | 0.1–0.5 | 0.22 |
| Al + Ti | 2.0–2.8 | 2.19 |
| Nb (+Ta) | — | 0.23 |
| C | 0.03 max. | 0.01 |
| Si | 0.5 max. | 0.26 |
| Mn | 1.0 max. | 0.62 |
| B | — | 0.004 |
| Fe | Balance 22.0 min. | 28.34 |
| S | 0.03 max. | |

*includes 0.32% Co

The specific alloy set forth in Table I was cast and hot rolled to a flat having cross-sectional dimensions of 15×100 mm. Specimens were cut having long transverse orientation and were annealed at 1010° C. for one hour and water quenched. Tensile test specimens were 9 mm diameter and 35.6 mm long.

Room temperature tensile test results are set forth in Table II based upon specimens which were isothermally aged at the temperatures and times indicated, followed by air cooling. Charpy V Notch test results are also given for the alloy resulting from the various test conditions.

TABLE II

| | Aging | | | | | | CVN Impact |
|---|---|---|---|---|---|---|---|
| Test | Temp. (°C.) | Time (H) | YS (MPa) | UTS (MPa) | El % | RA % | Energy Joules |
| A | 704 | 4 | 523 | 1027 | 38.0 | 55.0 | 133 |
| 1 | 704 | 8 | 554 | 1068 | 34.0 | 57.5 | 125 |
| 2 | 704 | 16 | 631 | 1103 | 30.5 | 52.0 | 104 |
| 3 | 704 | 24 | 714 | 1117 | 29.0 | 51.0 | 94 |
| B | 732 | 1 | 501 | 1000 | 38.0 | 59.0 | 137 |
| C | 732 | 4 | 589 | 1075 | 32.0 | 56.0 | 113 |
| D | 732 | 8 | 686 | 1103 | 29.0 | 52.5 | 83 |
| E | 732 | 16 | 738 | 1110 | 28.5 | 48.0 | 65 |
| F | 732 | 24 | 748 | 1117 | 26.5 | 47.5 | 56 |

Table II shows that, with respect to room temperature mechanical characteristics of the heat treated alloy, there is little to choose between heat treatments A through F outside the present invention and heat treatments 1 to 3 within the invention with the possible exception that, at Yield Strengths above about 550 MPa, aging at 732° C. produces alloy articles somewhat lower in Charpy Impact Value than articles aged to equivalent strength at 704° C.

Table III sets forth data obtained in slow strain rate tensile tests conducted at 204° C. in an autoclave with specimens immersed in an aqueous medium containing 20% sodium chloride, 0.5% acetic acid (glacial) and pressurized with 0.83 MPa gage hydrogen sulfide. In the tests reported in Table II specimens 3.5 mm diameter 25 mm long were strained at a constant rate of $4\times10^{-6}S^{-1}$.

TABLE III

| Heat Treatment | Time to Fracture (h) | Red of Area % | Elong % | Area under Curve ($cm^2$) | 0.2 YS (MPa) | UTS (MPa) | SCC* |
|---|---|---|---|---|---|---|---|
| 1 | 17.0 | 50.1 | 29.1 | 1289 | 502 | 959 | No |
| C | 6.1 | 19.5 | 5.8 | 361 | 705 | 929 | Yes |
| 3 | 17.4 | 46.2 | 26.9 | 1382 | 607 | 1058 | No** |
| F | 6.2 | 18.1 | 6.5 | 372 | 655 | 842 | Yes |

*Stress Corrosion Cracking
**No secondary cracking in addition to main fracture in fracture area. SCC in tensile specimen thread roots.

Table III clearly shows a distinct difference engendered in non-cold worked alloy objects by a small difference in aging temperature which is the discovery forming the basis of the present invention. With heat treatments 3 and F the alloy was hardened to a room temperature yield strength above 689 MPa as evidenced by Table II but with heat treatment 3 the alloy object did not exhibit stress corrosion cracking in the gage section of the test specimen whereas with heat treatment F such stress corrosion cracking was clearly evident. A similar phenomenon is observable when comparing heat treatments 1 and C. Room temperature yield strengths in the range of 550 to 600 MPa result from these heat treatments yet the alloy heat treated by process C is subject to stress corrosion cracking whereas the alloy heat treated by process 1 is not subject to stress corrosion cracking. The difference in fracture energy (area under the curve) between articles aged at 704° C. as opposed to articles aged at 732° C. is striking. This difference in fracture energy is indicative of a significant improvement in mechanical characteristics in alloy objects of the invention apart from the improvement by virtue of freedom from stress corrosion cracking.

More preferred heat treatments in accordance with the present invention comprise holding the alloy object solution annealed above 955° C. at a temperature above about 704° C. and below 732° C. for a time in excess of 8 hours e.g., 8 to 24 hours with longer times being employed at lower temperatures and vice versa. Following this aging treatment, the alloy object can be air cooled or, more advantageously, can be furnace cooled to about 621° C. e.g., 610–650° C. and held at that temperature for about 4 to 12 hours. Thereafter the alloy article is air cooled. Table IV sets forth two satisfactory heat treatments used on non-cold worked, solution treated alloy articles which provide alloy products resistant to stress corrosion cracking.

TABLE IV

| Heat Treatment | Aging Temp. | Furnace Cool Rate | 2nd Aging Temp | Time | R.T.Y.S. |
|---|---|---|---|---|---|
| 4 | 704° C. | 55°/hr | 621° C. | 8 hrs. | 711 MPa |
| 5 | 719° C. | 55°/hr | 621° C. | 8 hrs. | 768 MPa |

It is to be noted that, as exemplified, alloy structures in accordance with the present invention have been made by conventional melting, casting and working operations. If desired the alloy objects can be made by powder metallurgical methods wherein an alloy powder, perhaps made by atomization or by rapid solidification technique or as blend of elemental or master alloy powders is compacted, for example, by hot isostatic pressing to form a near net shape alloy object. The alloy object can also be made by casting in any conventional or non-conventional manner.

Those skilled in the art will appreciate that such modifications and variations are within the ambit of the appended claims as well as modifications and variations which will be readily apparent to those of normal skill in the art.

The embodiments of the invention in which an exclusive property or privilege is claimed are defined as follows:

1. A non-cold worked alloy structure in the annealed and aged condition comprising an alloy consisting essentially in percent by weight of about 38–46% nickel, about 19–24% chromium, about 2–4% molybdenum, about 1.5–3% copper, about 1–2.3% titanium, about 0.1–0.6% aluminum, the contents of aluminum plus titanium being about 1.5–2.8%, up to about 3.5% niobium, up to about 0.15% carbon, up to 0.1% nitrogen, up to about 5% cobalt, up to about 0.5% silicon, up to about 1% manganese, the balance being essentially iron, said alloy structure being in the condition resulting from annealing at a temperature at least 955° C. followed, without cold work intervention, by aging for at least 8 hours at a temperature in excess of 700° C. and below 732° C. for a time sufficient to induce in the alloy structure a room temperature 0.2% offset yield strength of at least 517 MPa and resistance to stress corrosion cracking.

2. An alloy structure as in claim 1 wherein the structure is aged to a room temperature yield strength of at least 689 MPa.

3. An alloy structure as in claim 1 wherein the structure is solution treated prior to aging at a temperature of about 960° to 1100° C.

4. An alloy structure as in claim 1 wherein the structure is furnace cooled from the aging temperature to a temperature of about 620°–625° C., held for about 4 to 12 hours and thereafter air-cooled.

5. An alloy structure as in claim 1 wherein the alloy consists essentially of in weight percent 42–46% nickel, 19.5–22.5% chromium, 2.5–3.5% molybdenum, 1.5–3.0% copper, 1.9–2.3% titanium, 0.1–0.5% aluminum, up to 0.03% carbon, up to 0.5% silicon, up to 1% manganese, up to 0.03% sulfur the balance at least 22.0% being iron.

6. A heat treatment adapted to be applied to an alloy consisting essentially in percent by weight of about 38–46% nickel, about 19–24% chromium, about 2–4% molybdenum, about 1.5–3% copper, about 1.2–3% titanium, about 0.1–0.6% aluminum, the contents of aluminum plus titanium being about 1.5–2.8%, up to about 3.5% niobium, up to about 0.15% carbon, up to 0.1% nitrogen, up to 5% cobalt, up to about 0.5% silicon, up to about 1% manganese, the balance essentially iron, said heat treatment comprising solution annealing, said alloy at a temperature of at least 955° C. followed, without cold work intervention, by aging for at least about 8 hours at a temperature in excess of 700° C. and below about 732° C. for a time sufficient to induce in the alloy a room temperature 0.2% offset yield strength of at least 517 MPa and resistance to stress corrosion cracking.

7. A process as in claim 6 wherein the alloy is aged to a room temperature yield strength of at least 689 MPa.

8. A process as in claim 6 wherein the solution treatment prior to aging is carried out at a temperature of about 960° to 1100° C.

9. A process as in claim 6 wherein the alloy is furnace cooled from the aging temperature to a temperature of about 620°-625° C., held for about 4 to 12 hours and thereafter air-cooled.

10. A process as in claim 6 applied to an alloy consisting essentially of in weight percent 42-46% nickel, 19.5-22.5% chromium, 2.5-3.5% molybdenum, 1.5-3.0% copper, 1.9-2.3% titanium, 0.1-0.5% aluminum, up to 0.03% carbon, up to 0.5% silicon, up to 1% manganese, up to 0.03% sulfur, the balance at least 22.0% being iron.

* * * * *